US008833898B2

(12) United States Patent
Shibasaki

(10) Patent No.: US 8,833,898 B2
(45) Date of Patent: Sep. 16, 2014

(54) IMAGE FORMING APPARATUS AND IMAGE FORMING METHOD

(75) Inventor: Akira Shibasaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 13/530,583

(22) Filed: Jun. 22, 2012

(65) Prior Publication Data

US 2013/0002747 A1 Jan. 3, 2013

(30) Foreign Application Priority Data

Jun. 28, 2011 (JP) ..... 2011-143425

(51) Int. Cl.
*B41J 29/393* (2006.01)
*B41J 19/14* (2006.01)

(52) U.S. Cl.
CPC ..... *B41J 19/147* (2013.01)
USPC ..... 347/19

(58) Field of Classification Search
USPC ..... 347/19
See application file for complete search history.

(56) References Cited

U.S. PATENT DOCUMENTS

| | | | | |
|---|---|---|---|---|
| 6,425,652 | B2 * | 7/2002 | Otsuki | 347/41 |
| 6,874,864 | B1 * | 4/2005 | Maeda et al. | 347/41 |
| 7,798,604 | B2 * | 9/2010 | Noguchi | 347/41 |
| 8,007,067 | B2 * | 8/2011 | Jahana et al. | 347/12 |

FOREIGN PATENT DOCUMENTS

| | | |
|---|---|---|
| JP | 3200143 B2 | 6/2001 |
| JP | 3236034 B2 | 9/2001 |

* cited by examiner

*Primary Examiner* — Lamson Nguyen
(74) *Attorney, Agent, or Firm* — Fitzpatrick, Cella, Harper & Scinto

(57) ABSTRACT

An image forming apparatus in which an operation of reciprocal scans of a print head including a plurality of ejection ports for ejecting at least two kinds of inks onto a print medium and an operation of conveying the print medium are repeatedly performed, and in the meanwhile ink is ejected from the print head to the print medium for printing, comprises input unit configured to input ejection data for ejecting the ink onto the print medium to form an image, calculating unit configured to calculate an area ratio of each ink on the surface of the print medium based upon the ejection data, and setting unit configured to set the ejection data in such a manner that the area ratio is generally constant in the reciprocal scans.

8 Claims, 12 Drawing Sheets

IMAGE FORMING APPARATUS AND IMAGE FORMING METHOD

BACKGROUND OF THE INVENTION

1. Field of the Invention

This invention relates to an image forming apparatus and an image forming method.

2. Description of the Related Art

Conventionally as a printing method for printing characters, an image and the like on a print medium such as a print paper or film, it is known that there is an Inkjet printing method for making ink as a print agent (color material) adhere on the print medium to form an image on the print medium.

Ink including pigment as a color material is widely used in an inkjet printing apparatus according to the inkjet printing method. The pigment ink has the feature that the color material as a solid content component tends to more easily deposit on a surface of the print medium, as compared to the dye ink. FIG. 1A and FIG. 1B illustrate schematic diagrams of the pigment color material which has deposited on the print medium.

A printing form of the inkjet printing apparatus includes the serial type of a form. In the serial type of the inkjet printing apparatus, ink is ejected from the print head while a main scan and a sub scan are alternately repeated, thus sequentially forming an image on the print medium. Here, printing of the main scan is performed such that a carriage mounting the print head thereon moves over the print medium in the main scan direction for printing. On the other hand, printing of the sub scan is performed along with the change of a printing position by carrying the print medium in a direction perpendicular to the main scan direction by a predetermined amount. In this case, a width of a region to be printed by the main scan of one time is defined by a head length of a plurality of ink ejection ports provided in the print head.

For further enhancing a quality level of an image, a multi-scan method is adopted. The multi-scan method performs printing of main scans by N number of times ($N \geq 2$) onto an image region printable by printing of the main scan of one time. Adoption of the multi-scan method brings in the effect that, by carrying the print medium by a predetermined amount in printing of each main scan, variations in printing by each print element and variations in a sub scan amount are dispersed to smooth an entire image. Therefore in the serial type of the inkjet printing apparatus, the multi-scan method is advantageously adopted at present.

The effect of the multi-scan method can become the larger as the more numbers of multi-scans are set, but on the other hand, may lead to an increase of operation time in printing. In recent years, an inkjet printing apparatus has some recording modes respectively set with the number of multi-scan, and a user can select an appropriate mode in accordance with the type or the application of the print image.

In addition, the printing of the main scan in the multi-scan method includes two methods, that is, one-way printing in which the printing is performed only in the forward direction and bidirectional printing in which the printing is performed alternately in both of the forward direction and the backward direction. In the bidirectional printing, an image region formed by the scan in the forward direction and an image region formed by the scan in the backward direction are alternately generated in each width of the regions printed by the printing main scan of one time. Without mentioning, a printing speed in the bidirectional printing is faster than in the one-way printing.

However, there are some cases where "band irregularities" generates in the bidirectional printing, which does not generate in the one-way printing. "The band irregularity" is the problem occurring because of a difference in an arrangement of ink colors to be printed between the image region formed by the scan in the forward direction and the image region formed by the scan in the backward direction. That is, even if the printing is performed according to the same data, there occurs a difference as clear as to be visually confirmable between a color of the image printed in the forward direction and a color of the image printed in the backward direction. Particularly in a case of using the pigment ink, since the color material has the properties of tending to accumulate on a surface of the print medium, the arrangement of the ink colors to be printed has a great impact on the image quality. As a result, in some cases the ink irregularity is noticeable.

Hereinafter, it will be explained with reference to FIGS. 2A and 2B that the arrangement of the ink colors to be printed is different depending on the scan direction. Here, there will be explained an example where two kinds of cyan ink and magenta ink are used to cause both of the inks to land on a predetermined position of the print medium one by one.

FIG. 2A illustrates printing in the forward direction and FIG. 2B illustrates printing in the backward direction. A head 201 is provided with a cyan nozzle 202 used for printing cyan ink and a magenta nozzle 203 used for printing magenta ink. In a case where the forward direction is defined as a front side in the printing main scan direction, the cyan nozzle 202 and the magenta nozzle 203 are assumed to be arranged in order from the front side. As shown in FIG. 2A, in a case of the forward scan, since the nozzle of the cyan ink performs ejection ahead of the nozzle of the magenta ink, the cyan ink lands on the print medium ahead of the magenta ink (cyan dot 204), and the magenta ink lands on the cyan ink (magenta dot 205). On the other hand, as shown in FIG. 2B, in the backward scan, since the nozzle of the magenta ink performs ejection ahead of the nozzle of the cyan ink, the magenta ink lands on the print medium ahead of the cyan ink (magenta dot 205), and the cyan ink lands on the magenta ink (cyan dot 204). As described above, since the landing-on order of the ink colors to be printed differs between the forward scan and backward scan, the arrangement of the ink colors to be printed results in being different depending on the direction of the printing scan.

Some measures using mask patterns against the band irregularity are disclosed in public. It should be noted that the mask pattern is used for image data in multi-scan printing for each printing main scan (also called as a pass).

For example, it is proposed a method "in which in a plurality of thinning mask patterns corresponding to colors differing with each other, a pixel arrangement of at least one of the thinning mask patterns is different from a pixel arrangement of the other thinning mask pattern" (for example, Japanese Patent No. 3200143). In the same printing scan, the printing is performed in positions different with each other between respective colors, thus reducing a difference in color between the forward printing and the backward printing.

In addition, it is proposed a method in which a mask pattern is provided to correspond to each of a plurality of blocks in a fixed manner and a mutual interpolation relation is maintained between the blocks, which is applied in the same way between a first print head and a second print head (for example, Japanese Patent No. 3236034). According to this structure, by fixing the mask pattern to the print head, band irregularities due to a deviation in a printing ratio between the respective printing scans generated by an arrangement state between the mask pattern and the image data can be reduced.

However, the method described in Japanese Patent No. 3200143 or Japanese Patent No. 3236034 has no system for changing the processing corresponding to the image, and therefore, for example, in a case of an input image where the band irregularity tends to be noticeable, it is hard to say that the band irregularity can be sufficiently reduced.

Therefore an object of the present invention is to reduce band irregularities regardless of an input image.

Further features of the present invention will become apparent from the following description of exemplary embodiments with reference to the attached drawings.

SUMMARY OF THE INVENTION

For solving the above problem, the present invention provides an image forming apparatus in which an operation of reciprocal scans of a print head including a plurality of ejection ports for ejecting at least two kinds of inks onto a print medium and an operation of conveying the print medium are repeatedly performed and in the meanwhile ink is ejected from the print head to the print medium for printing, comprising input unit configured to input ejection data for ejecting the ink onto the print medium to form an image, calculating unit configured to calculate an area ratio of each ink on the surface of the print medium based upon the ejection data, and setting unit configured to set the ejection data in such a manner that the area ratio is generally constant in the reciprocal scans.

According to the present invention, the band irregularity can be reduced regardless of the input image.

Further features of the present invention will become apparent from the following description of exemplary embodiments with reference to the attached drawings.

DESCRIPTION OF THE EMBODIMENTS

In the present embodiment, there will be explained a so-called serial printer which repeats a series of operations to move a print head having a plurality of ejection ports for ejecting ink from the print head to the print medium and to carry the print medium to the position of next printing. For reducing band irregularities, it is important that an arrangement of ink colors to be printed is coincident between an image region beginning with a forward scan and terminating with a backward scan and an image region beginning with a backward scan and terminating with a backward scan. However, even if the arrangements are not completely coincident, an improvement of the image quality is possible by making at least a ratio of inks exposed on the outermost surface (hereinafter, called a color material distribution) be coincident therebetween. Here, the color material distribution is indicated, for example, by an area ratio of inks or a dot number. Hereinafter, the details of embodiments will be explained.

(First Embodiment)

It is possible to reduce band irregularities by improving multi-scan printing for performing printing with a plurality of times of scan operations of a print head on the same region of a print medium in regard to the same color. For example, it is effective to increase the number of times of multi-scans. Since the printing per one time scan is small, a difference in the order of ink colors to be printed is made small. Therefore it is considered that in a case of an input image where the band irregularity tends to be noticeable, printing is performed by the more pass numbers in plural printing scans and in a case of an input image where the band irregularity is hardly noticeable, printing is performed by the fewer pass numbers in plural printing scans. In the first embodiment, it will be explained that an image printing apparatus prints with a pass number calculated from a color material distribution difference about the input image.

(Outline of Printing System)

Figure 1A:
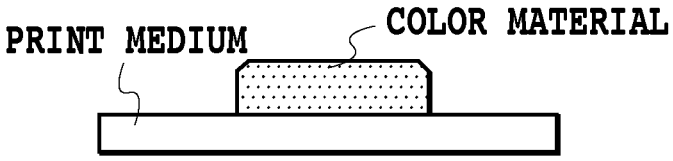
FIG. 1A and FIG. 1B are a side view and a plan view schematically illustrating a state of a color material accumulating on a print medium.
Figure 1B:
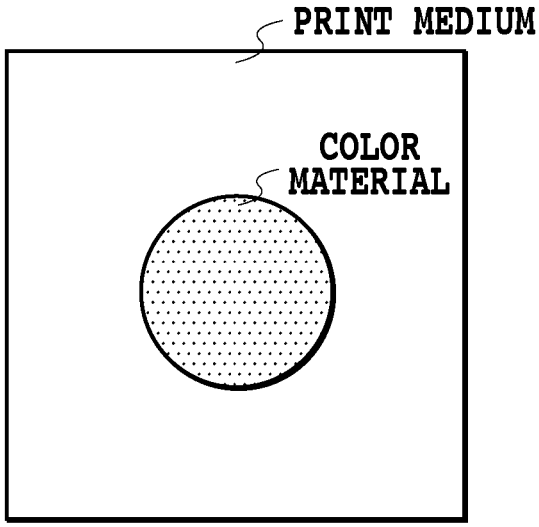
Figure 2A:
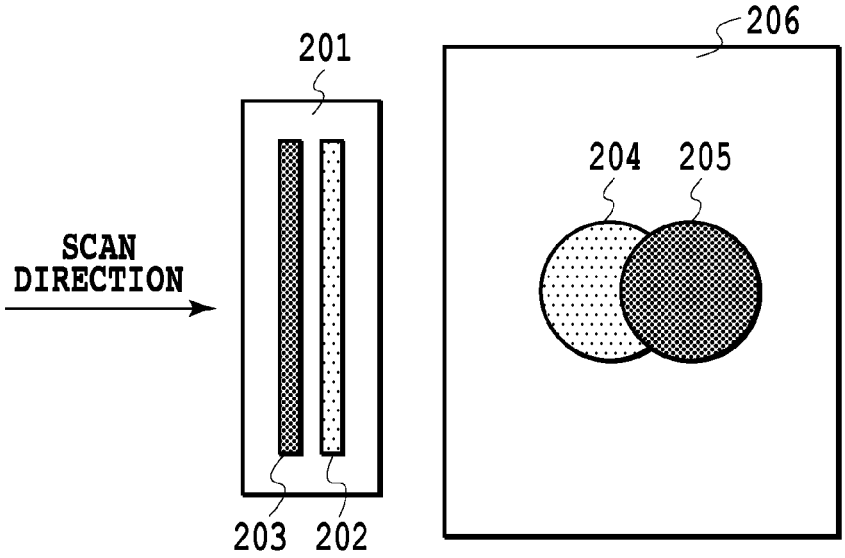
FIG. 2A and FIG. 2B are diagrams schematically illustrating a state of forming color materials in a case where the printing order of ink colors differs depending on a direction of a printing scan.
Figure 2B:
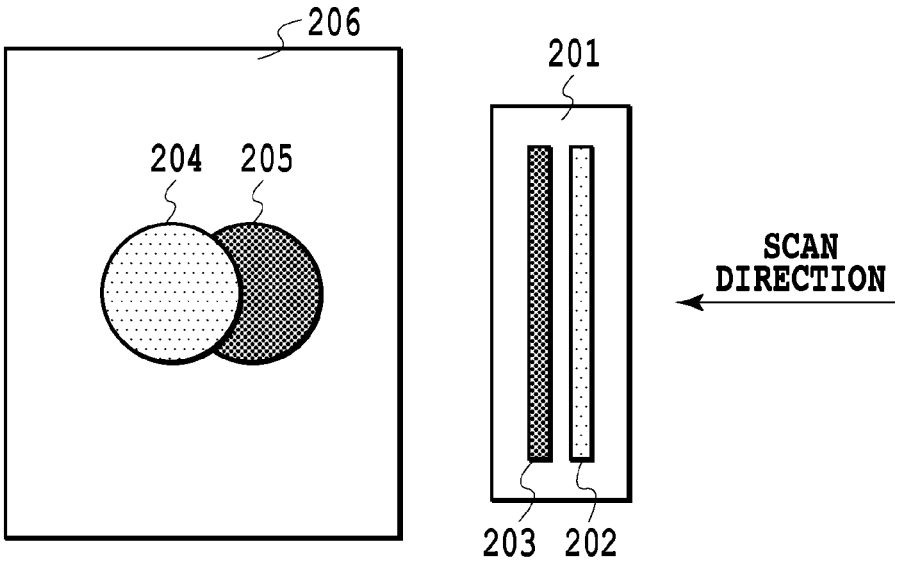
Figure 3:
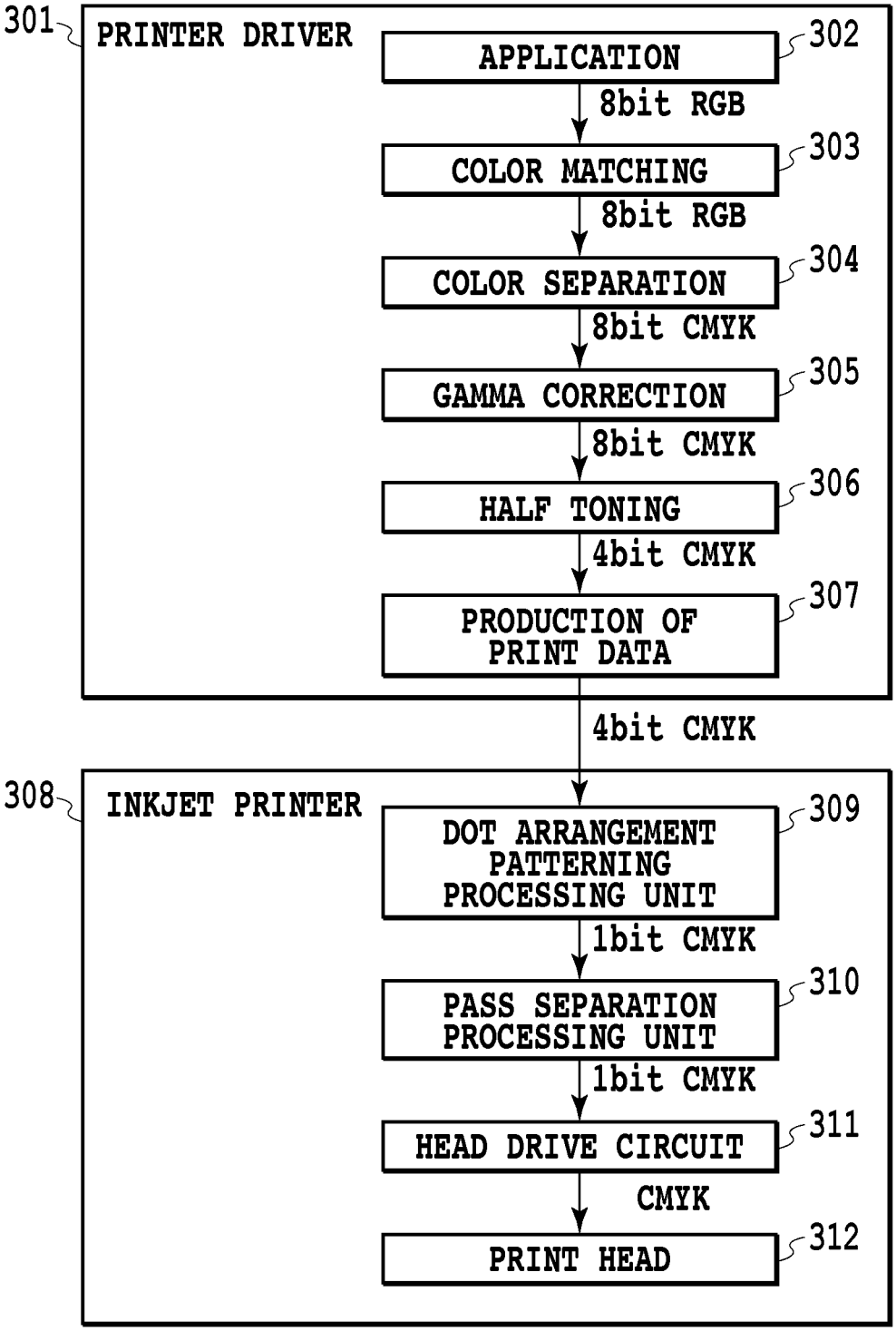
FIG. 3 is a block diagram illustrating the construction of a printing system according to the present embodiment.

FIG. 3 illustrates a printing system according to the present embodiment. The printing system has a host device (PC) such as an information processing device and an image forming apparatus (e.g. inkjet printer) using an inkjet method. The information processing device includes a central processor unit (CPU) for controlling an entire apparatus, a read-on memory (ROM) and a random-access memory (RAM) in which temporal reading and writing are performed by the CPU at calculation processing (not illustrated), and the like.

The inkjet printer has colored inks of four colors of cyan (C), magenta (M) and yellow (Y) as basic colors and further, black (K), each ink including pigment as a color material. The inkjet printer performs printing by four colors of inks. Therefore the inkjet printer is provided with a print head for ejecting inks of four colors. At least two or more kinds of printing materials are used in the present embodiment.

An application or a printer driver is present as a program operating in an operating system of a PC. The application executes various processing for image data to be printed by a printer. The image data or image data prior to editing can be imported in the PC via various mediums. The PC imports from a CF card image data, such as JPEG format, photographed by a digital camera. In addition, image data read by a scanner, for example, image data of TIFF format or image data stored in a CD-ROM can be imported. Further, image data on the Web may be imported via the Internet. The imported image data may be displayed on a monitor in the PC to be edited and processed via an application. For example, RGB image data expressed by R, G, B signals of standard RGB is produced, and the RGB image data (input image data) is delivered to a printer driver 301 in response to an instruction of printing.

The printer driver 301 executes each processing at color matching 303, a color separation unit 304, gamma correction 305, half toning 306, and a print data producing unit 307.

The color matching 303 performs matching of gamut. The color matching 303 converts RGB data of eight bits into RGB data within the gamut of the printer by using a three-dimensional lookup table (LUT) and interpolation calculation together.

The color separation unit 304 calculates color separation data (CMYK data) corresponding to a combination of inks for reproducing colors expressed by the RGB data based upon the RGB data subjected to the mapping of gamut. The processing is carried out by using the three-dimensional LUT and the interpolation calculation together as similar to the color matching. Data to be outputted from the color separation unit 304 is data of eight bits for each color, and is a value corresponding to a color material amount of each color material of C, M, Y and K.

The gamma correction 305 performs gradation value conversion to the color separation data of each color calculated by the color separation unit 304. Specifically, a primary LUT corresponding to gradation characteristics of each color ink is used to perform the conversion such that the color separation data linearly corresponds to the gradation characteristics of the inkjet.

The half toning 306 performs quantization converting C, M, Y and K signals in the color separation data (CMYK data) of eight bits into image data of four bits. In the present embodiment, the eight-bit data is converted into the four-bit data by using an error diffusion method. The image data of four bits is index data for showing an arrangement pattern in a dot arrangement patterning processing unit 309 in the inkjet printer. It should be noted that the quantization is not limited to the error diffusion method, and for example, the quantization may be performed by threshold processing using a dither matrix, for example. Further, the quantization may be performed by providing a correlation between the respective signals of C, M, Y and K.

Finally the print data producing unit 307 produces print data by adding to the print image data printing control information including the index data of four bits. The processing of the aforementioned application and printer driver is carried out according to each program by the CPU. On this occasion, the program is read out from the ROM or the hard disc for use, and the RAM is used as a work area at the time of executing the processing. The print data is outputted to an inkjet printer 308.

The inkjet printer 308 has the dot arrangement patterning processing unit 309, a pass separation processing unit 310, a head drive circuit 311, and a print head 312.

The dot arrangement patterning processing unit 309 performs a dot arrangement according to a dot arrangement pattern corresponding to the index data of four bits (gradation value information) as a print image for each pixel corresponding to an actual print image. In the aforementioned half toning 306, multi-valued concentration information of 256 values (eight-bit data) is lowered in level number to the gradation value information of nine values (four-bit data). However, the printing of the inkjet printer is information of a binary value whether or not ink is printed. In the dot arrangement patterning processing unit 309, to each pixel expressed by four-bit data of levels 0 to 8 as output values from the half toning 306, a dot arrangement pattern corresponding to the gradation value (levels of 0 to 8) of the pixel is allotted. As a result, ON/OFF of the dot is defined for each of a plurality of areas within one pixel. That is, it is defined whether or not the dot is formed in each of the plurality of areas within one pixel, and binary ejection data composed of "1" or "0" is arranged for each area within one pixel.

The pass separation processing unit 310 produces pass separation data for each scan based upon the ejection data of one bit obtained by the dot arrangement patterning. The details of the processing of producing the pass separation data will be explained later.

The pass separation data for each scan is sent to the head drive circuit 311 at proper timing, and thereby the print head 312 is driven to eject ink of each color according to the pass separation data. The dot arrangement patterning processing unit 309 and the pass separation processing unit 310 in the inkjet printer are carried out under the control of the CPU as a control unit by using the hardware circuit exclusive thereto. The processing may be carried out according to the program by the CPU or the processing may be carried out by, for example a printer driver in the PC.

It should be noted that, in the present specification, the inks as printing materials are cyan, magenta, yellow, and black. A color or the data indicating a color, or the hue is expressed by one capital letter of C, M, Y, K, or the like. That is, C expresses a cyan color, the data or the hue. Likewise M expresses magenta, Y expresses yellow, and K expresses black.

Further, in the present specification, "pixel" is the minimum unit which can be expressed by gradation, and is the minimum unit as a target in the image processing of multi-valued data of plural bits (processing of the color matching, color separation, γ correction, half toning or the like). In the half toning, one pixel corresponds to a pattern composed of 2×4 blocks, and each block within one pixel is defined as an area. The "area" is the minimum unit in which ON/OFF of a dot is defined. In regard to this, "image data" in the color matching, the color separation, and the γ correction expresses a collection of pixels as a processing target, and each pixel is data having a gradation value of eight bits. "Image data" in the half toning expresses image data itself as a processing target, and image data having the gradation value of eight bits is converted into pixel data (index data) having the gradation value of four bits.

(Structure of Print Head)

Hereinafter, the structure of a head cartridge H1000 according to the present embodiment will be explained.

Figure 11B:
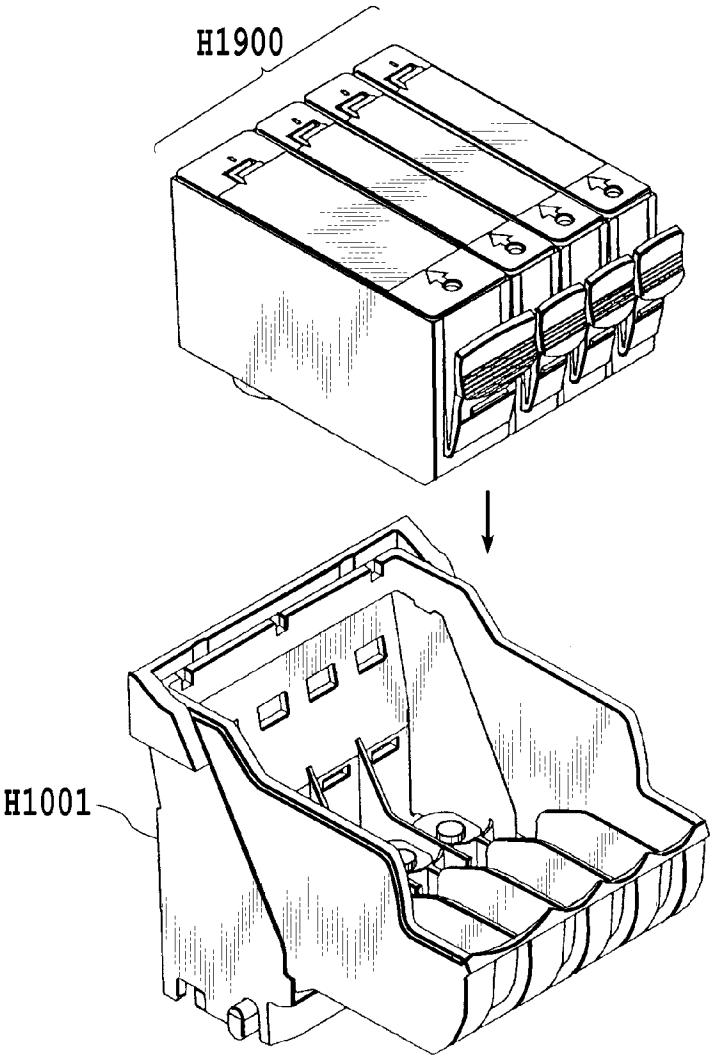
FIG. 11A and FIG. 11B are perspective views illustrating the process of mounting an ink tank on a head cartridge applied in the present embodiment.
Figure 11A:
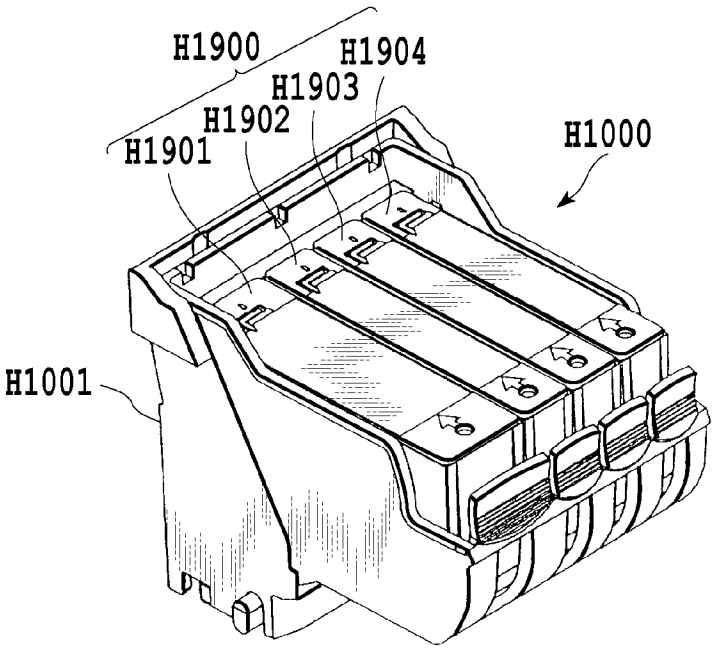

As shown in FIG. 11A, the head cartridge H1000 in the present embodiment includes a print head H1001, means for mounting an ink tank H1900, and means for supplying ink from the ink tank H1900 to the print head. In addition, the head cartridge H1000 is removably mounted on a carriage.

FIG. 11B is diagrams illustrating the aspect of mounting the ink tank H1900 on the head cartridge H1000 according to the present embodiment. In the inkjet printer, since an image is formed by inks of four colors composed of cyan, magenta, yellow, and black, the ink tank H1900 is provided with four tanks corresponding to four colors (H1901 to H1904) independently.

Figure 12:
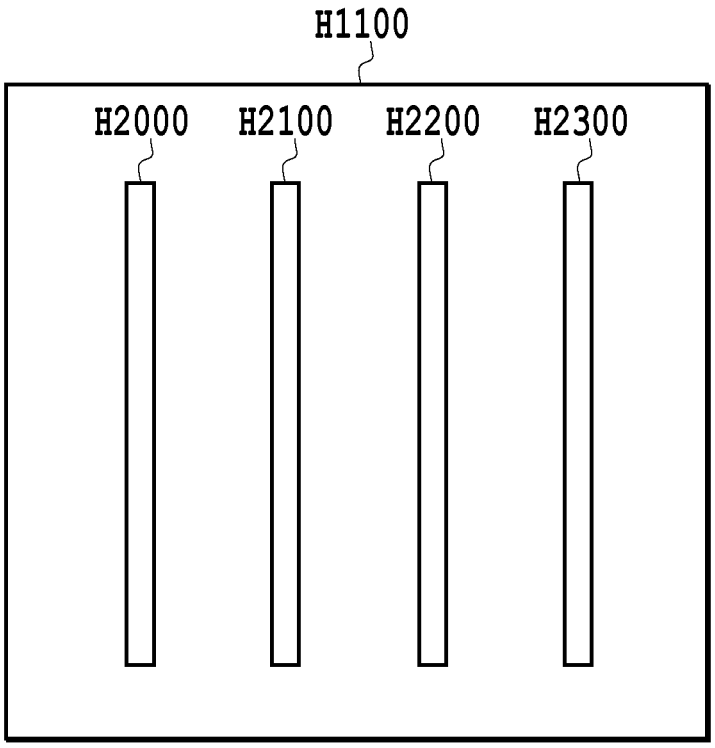
FIG. 12 is a view illustrating the head cartridge applied in the present embodiment.

FIG. 12 illustrates a print element substrate H1100. The print element substrate H1100 consists of a Si substrate. On a half surface of the print element substrate H1100, a plurality of print elements (nozzles) are formed as ejection port for ejecting ink. Electric wiring such as AI for supplying power to each print element is formed by a film forming technology, and a plurality of ink flow passages corresponding to the individual print elements are also formed by a photolithography technology. Further, ink supply ports for supplying ink to the plurality of ink flow passages are formed to be opened to the back surface. H2000 to H2300 are rows of the print elements (hereinafter, nozzle rows) corresponding to different ink colors. The nozzle rows corresponding to four colors are provided in the print element substrate H1100, which include a nozzle row H2000 to which cyan ink is supplied, a nozzle row H2100 to which magenta ink is supplied, a nozzle row H2200 to which yellow ink is supplied, and a nozzle row H2300 to which black ink is supplied.

(Pass Separation Processing Unit)

Subsequently the processing by the pass separation processing unit 310 according to a first embodiment will be in detail explained. The pass separation processing unit 310 determines the pass number in such a manner that band irregularities are reduced corresponding to a content of image data to be inputted, to the inputted ejection data, and outputs the pass separation data. Specifically firstly in a case where printing is performed by the designated pass number, it is determined whether or not there is a possibility that band irregularities are generated. In a case where it is determined that there is the possibility that the band irregularities are generated, a change of increasing the pass number is made, and the same processing is carried out. In a case where it is determined that there is no possibility that the band irregularities are generated, the pass separation data is outputted without changing the pass number. The head in the present embodiment uses a head having a nozzle arrangement in which cyan, magenta, yellow, and black are ejected in that order to the same pixel in a case of the forward scan in the reciprocal printing. When this head is used, black, yellow, magenta, and cyan are ejected in that order to the same pixel in the backward scan in reverse to the above.

Figure 4:
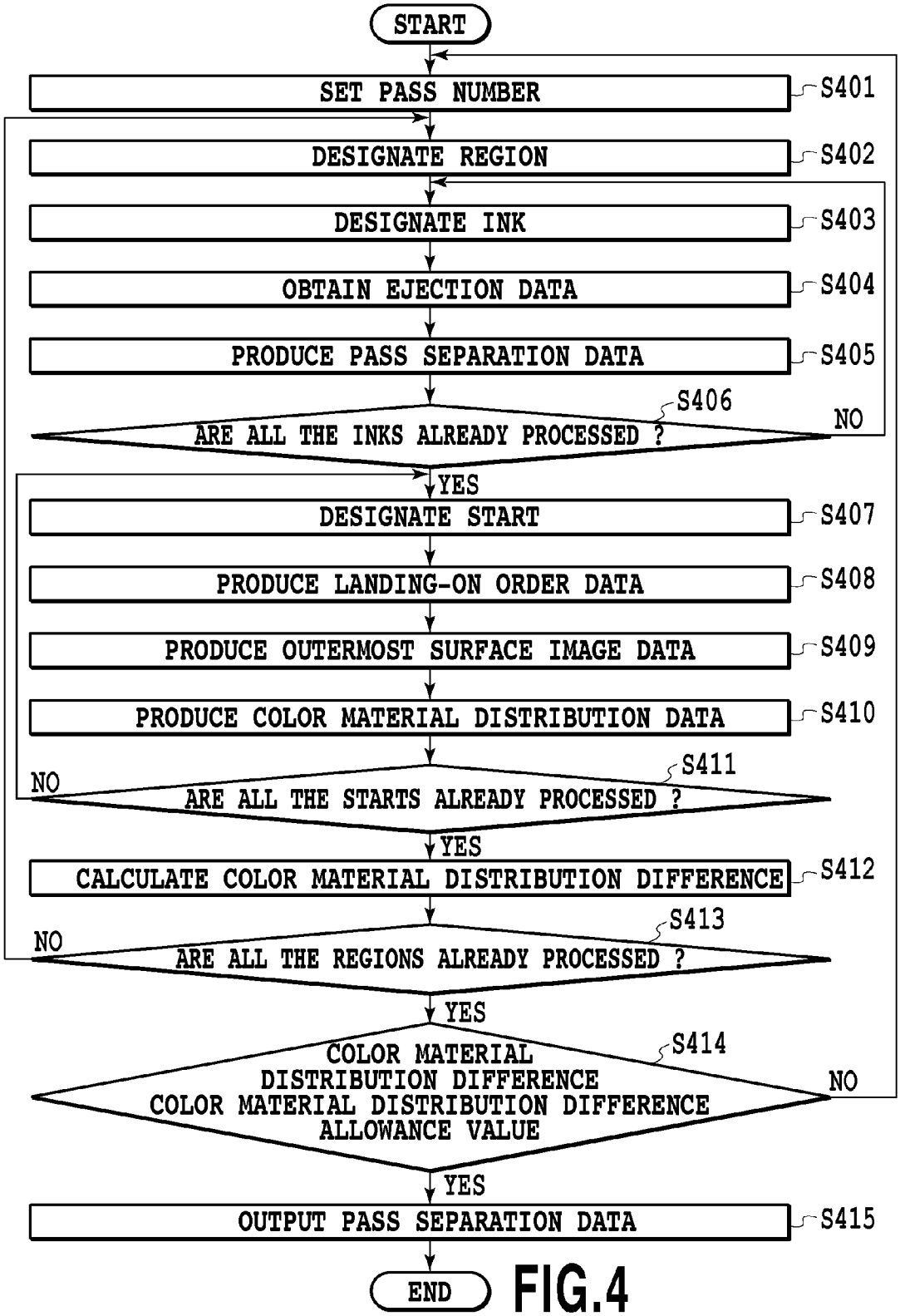
FIG. 4 is a flowchart illustrating the procedure of a pass separation processing unit according to a first embodiment.

FIG. 4 is a flow chart illustrating the procedure of the processing by the pass separation processing unit 310.

By the processing from S401 to S406, pass separation data of all the inks of the designated pass number in the designated region is produced.

First, when the process starts, the pass number is set (S401). At first, an initial pass number is set. The larger pass number is set according to the processing content. For example, when the initial pass number is four, the pass numbers are set as four, six, eight, . . . , in that order.

Figure 5:
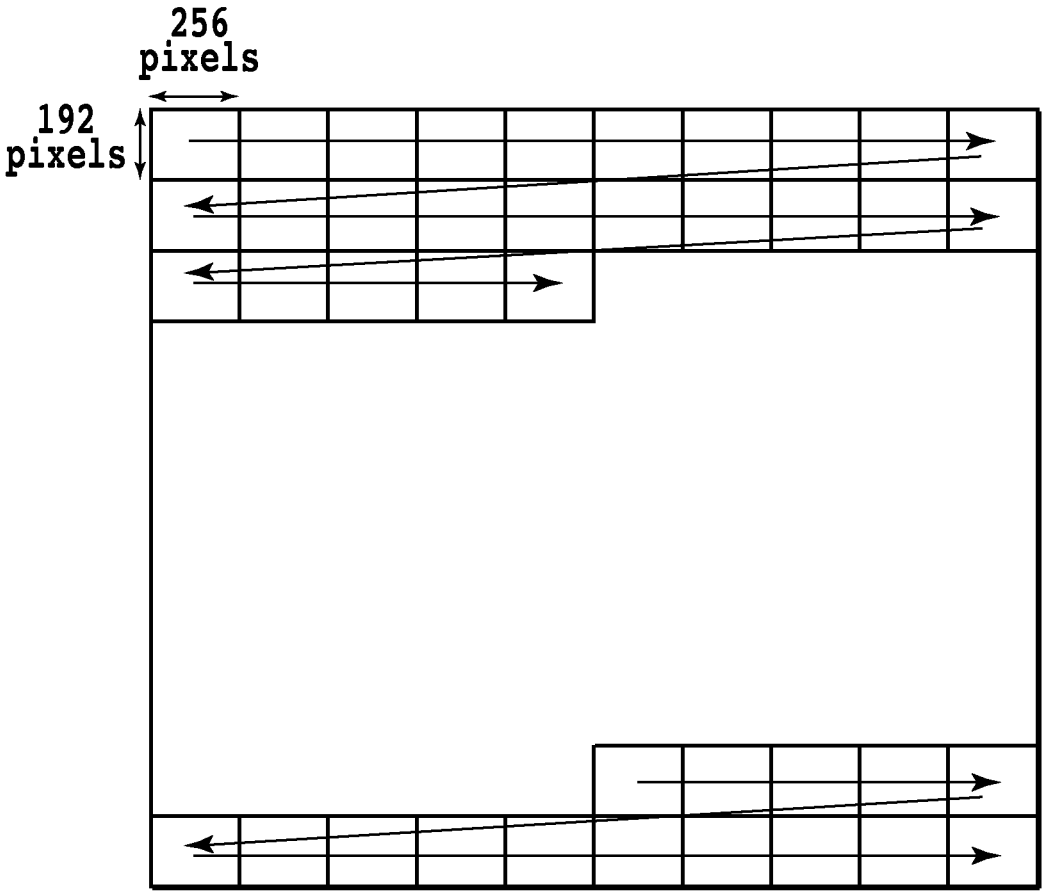
FIG. 5 is a diagram explaining a region designation of ejection data.

Next, a region which is a processing target in the ejection data is designated (S402). FIG. 5 is a diagram explaining a designation of the region in the ejection data. First, a region in the left top end of the ejection data is designated. When the processing of S403 to S413 is carried out and the process goes back to S402, next a region to be designated is switched to a region in the right direction. When the designation is made to the right end of the uppermost end row, next the left end region in the region row lower by one step is designated. The regions to be designated are switched in that order, and the designation of the regions is completed at the region in the right bottom end (S413; YES). A size of the region to be designated is defined by 192 pixels in the vertical direction and 256 pixels in the lateral direction. A size of the pixels in the vertical direction corresponds to a value found by dividing a nozzle length by the pass number. A size of the pixels in the lateral direction is not limited to 256 pixels.

Next, ink for producing the pass separation data is designated (S403). First, cyan is designated as an initial, and inks are designated in the order of magenta, yellow, and black to execute the processing to all the inks Ejection data in regard to the ink designated at S403 in the region designated at S402 is obtained (S404).

Next, pass separation data is produced from the obtained ejection data by using mask patterns (S405). Here, the ejection data is represented by A [i, j], the mask pattern is represented by B [i, j, l], and the pass separation data is represented by C [i, j, l]. Here, "i" shows a pixel position in the vertical direction, and is a value in a range of 0 to 191. "j" shows a pixel position in the lateral direction, and is a value in a range of 0 to 255. "1" shows a scan. A first scan is represented by "1", as a second scan is represented by "2", a third scan is represented by "3", and a fourth scan is represented by "4". The pass separation data is produced by an AND operation of the ejection data and the mask pattern for each pixel of each color. That is, the processing of $C[i, j, l]=A[i, j] \cap B[i, j, l]$ is carried out. It should be noted that B [i, j, l] has an interpolation relation with each other for each pixel. That is, a formula of $B[i, j, 1]+B[i, j, 2]+B[i, j, 3]+B[i, j, 4]=1$ is established by inputting any i and j without any question. A dot is printed by any scan without any question because of the interpolation relation with each other.

Next, it is determined whether or not the processing is carried out to all the inks (S406). In a case where it is determined that the processing is carried out to all the inks, the process goes to S407, and in a case where it is determined that the processing is not carried out thereto, the process goes back to S403.

At subsequent S407 to S411, color material distribution data required for determining a possibility that band irregularities are generated is produced. One is color material distribution data on the outermost surface calculated as start of the forward scan, and another is color material distribution data on the outermost surface calculated as start of the backward scan.

First, a start is designated (S407). Here, the start of the forward scan is first designated. Next, the start of the backward scan is designated.

Next, landing-on order data is produced (S408). The landing-on order data is data showing the order by which dots land on the print medium. The landing-on order data is indicated at D [i, j, 1]. Here, i shows a pixel position in the vertical direction, and is a value in a range of 0 to 191. j shows a pixel position in the lateral direction and is a value in a range of 0 to 255. "k" shows a color, and cyan is specified by "1", magenta is specified by "2", yellow is specified by "3", and black is specified by "4". "1" expresses a scan, where a first scan is represented by "1", a second scan is represented by "2", a third scan is represented by "3", and a fourth scan is represented by "4". The landing-on order data has any value of 0 to $192 \times 4=768$, wherein 0 expresses no landing-on, numerals other than 0 express the landing-on order. For example, D [2, 3, 1, 1] means that the pixel position in the vertical direction is 2, the pixel position in the lateral direction is 3, and cyan ink lands on as the tenth dot among all the dots at the first scan.

The landing-on order of dots is uniquely determined according to the following rule. First, dots land on in the order of the first scan, the second scan, the third scan, and the fourth scan. Within the same scan, dots land on in the order of cyan, magenta, yellow and black in the forward scan and dots land on in the order of black, yellow, magenta and cyan in the backward scan. Further, in a case of the same color in the same scan, dots land on the pixel positions in the lateral direction in order from small to large in the forward scan, and dots land on the pixel positions in the lateral direction in order from large to small in the backward scan. In a case where at S407, the forward scan start is designated, the first scan is calculated as the forward scan, the second scan is calculated as the backward scan, the third scan is calculated as the forward scan, and the fourth scan is calculated as the backward scan. On the other hand, in a case where the backward scan start is designated at S407, the above calculations are in reverse to a case of the forward scan start.

Next, outermost surface image data is produced from the landing-on order data (S409). The outermost surface image data indicates ink landed on the outermost surface. The outermost surface image data is indicated at E [i, j]. Here, "i" is a pixel position in the vertical direction, and is a value in a range of 0 to 191. "j" is a pixel position in the lateral direction, and is a value in a range of 0 to 255. The outermost image data has a value in a range of 0 to 4. This numeral expresses a paper or ink, wherein a paper is indicated at 0, cyan is indicated at 1, magenta is indicated at 2, yellow is indicated at 3, and black is indicated at 4. For example, when E (2, 3)=1, it means that cyan is present on the outermost surface where the pixel position in the vertical direction is 2, and the pixel position in the lateral direction is 3.

Figure 6:
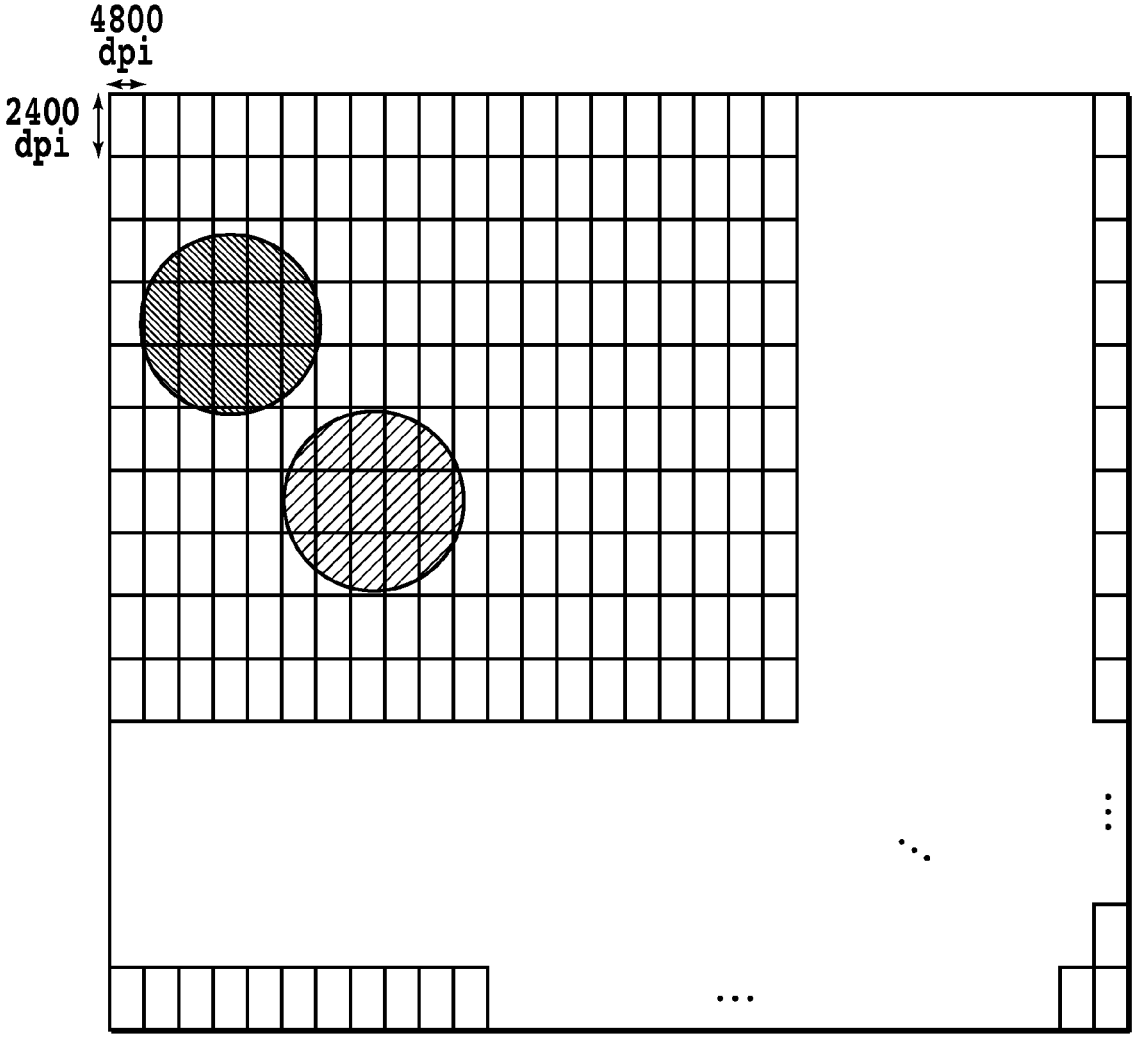
FIG. 6 is a schematic diagram expressing a relation between a printing resolution and a size of a dot.
Figure 7:
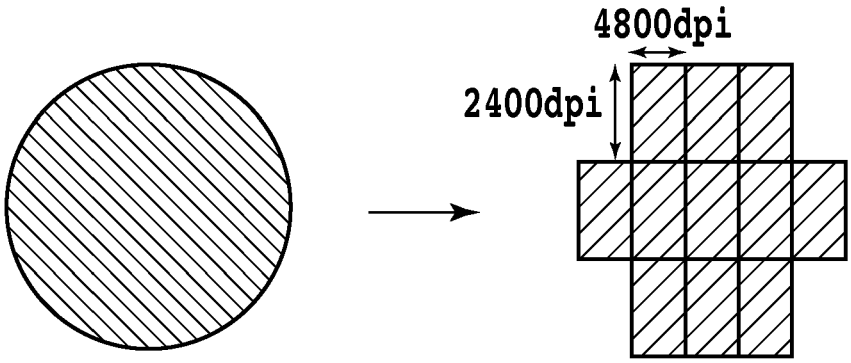
FIG. 7 is a diagram illustrating modeling of a dot.
Figure 8:
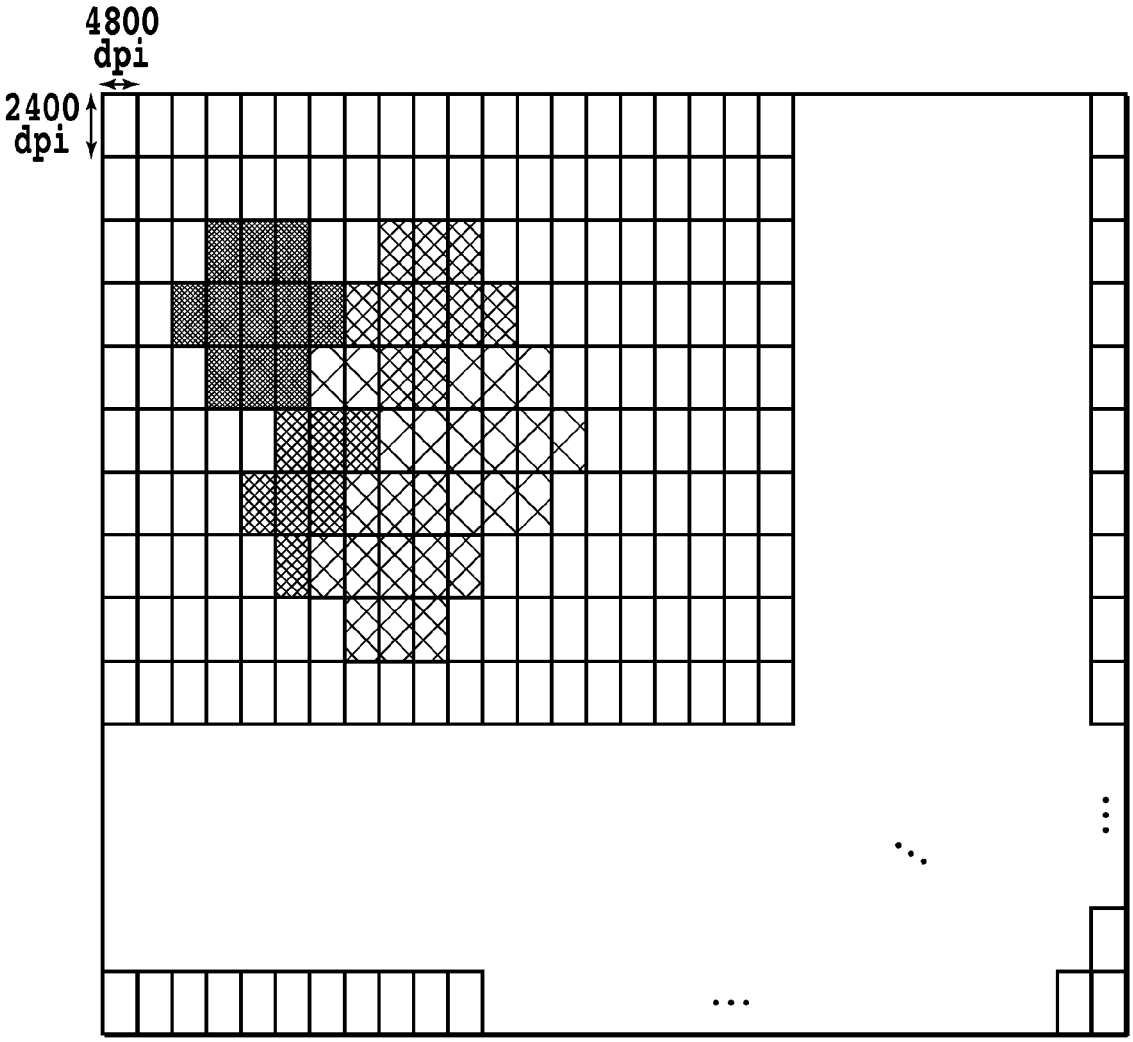
FIG. 8 is a diagram illustrating an example of the outermost surface image according to the present embodiment.

In addition, considering that the dot has a limited magnitude, a size of the dot is modeled. Dots overlap with each other more than a little on a print medium depending on a size of the dot. For example, there will be considered a case of an inkjet printer in which a resolution of a pixel has 4800 dpi×2400 dpi and an ejection amount of ink is 2 pl. A dot which has landed on a print medium is formed as a circle having a size of a diameter of about 30 μm. FIG. 6 illustrates a relation in size between a pixel and a dot. It is found out that the dot has an influence on the adjacent pixel and further, the adjacent pixel thereto in the vertical direction, and on the adjacent pixel in the lateral direction. Therefore modeling is made as shown in FIG. 7. It is assumed that peripheral pixels on which a dot landing on some pixel has an influence are ten pixels. The outermost surface image data is produced by the modeling and the landing-on order data. Specifically the outermost surface image data is arranged from the dot having the earlier landing-on order to update the kind of ink in the pixel of the outermost surface image data. FIG. 8 is a diagram illustrating actual outermost surface image data.

Next, color material distribution data will be produced (S410). Specifically an area ratio of ink is calculated for evaluating a color material distribution based upon the outermost surface image data. Here, the color material distribution data is indicated at F(k). "k" expresses a color, a paper is indicated at 0, cyan is indicated at 1, magenta is indicated at 2, yellow is indicated at 3, and black is indicated at 4. The color material distribution data has an integral number of any of 0 to 192×256. F(k) is a pixel number of E (i, j)=k. For example, when F(2)=1000, it means that in the designated region, magenta ink exposed on the outermost surface is 1000 pixels.

Next, it is determined whether or not all the starts are processed (S411). In a case where it is determined that all the starts are processed, the process goes to the next step, and in a case where it is determined that all the starts are not processed, the process goes back to S407.

Subsequently a color material distribution difference is calculated from color material distribution data of the forward scan start and color material distribution data of the backward scan start (S412). The color material distribution data of the forward scan start is indicated at F1(*k*), and the color material distribution data of the backward scan start is indicated at F2(*k*). E in the first embodiment is found according to the following expression by addition of data in all the regions to be processed.

[Expression 1]

$$E = \frac{1}{N}\sum_{AR}\sum_{k=0}^{4}(F1(k) - F2(k))^2, \qquad \text{(Expression 1)}$$

wherein N indicates the number of regions and AR indicates all the regions.

E becomes 0 unless there is any color material distribution difference, and as the color material distribution difference is the larger, E becomes the larger value.

Next, it is determined whether or not the processing has been carried out in all the regions (S413). When it is determined that the processing has been carried out in all the regions, the process goes to S414, and when it is determined that the processing has not been carried out in all the regions, the process goes to S402.

Then it is determined whether or not the color material distribution difference is smaller than a color material distribution difference allowance value (S414). The color material distribution difference allowance value is a value retained in advance in the pass separation processing unit 310.

When the color material distribution difference is smaller than the color material distribution difference allowance value, it is determined that band irregularities are not generated, and the process goes to S415. When it is determined that it is not smaller, the process goes back to S401. When a value of the color material distribution difference allowance value is large, the color material distribution difference tends to be allowed. The color material distribution difference allowance value may change corresponding to a quality level to be set. For example, it is considered that in a high-quality level mode, this value is made small, and in a high-speed mode, this value is made large.

Finally the pass separation data corresponding to the set pass number at S401 is outputted, and the processing ends (S415).

It should be noted that in the present embodiment, as a method of calculating the color material distribution difference, the expression explained in the processing at S412 is used, but not limited to that expression. Any expression may be used as long as the color material distribution difference can be quantified. For example, there are some cases where when the maximum value is used as in the following expression, a correlation with an actual band irregularity is the higher.

[Expression 2]

$$E = \frac{1}{N}\sum_{AR}\max_{k=0,1,2,3,4}(F1(k) - F2(k))^2, \qquad \text{(Expression 2)}$$

wherein N indicates the number of regions, and AR indicates all the regions.

In addition, in regard to the modeling of a dot, modeling other than the one illustrated in FIG. 6 may be used. For example, when the modeling of the dot changes corresponding to an ejection amount, the color material distribution difference can be calculated with higher accuracy. Further, the modeling of the dot may change corresponding to the feature of the head. For example, there is a method of dividing the modeling of the dot into three kinds in a case of the head having nozzles composed of three kinds of ejection amounts. The present embodiment may be applied to various scan methods. Examples of the scan method include a band feeding scan, an interlace scan, a division scan, and the like. Even if the scam method changes, as long as the landing-on position of the dot can be calculated, it is possible to calculate the color material distribution.

It should be noted that in the present embodiment, the calculation size of the outermost surface image data is the same as the resolution of the pass separation data, but may be different therefrom. For example, when the resolution of the outermost surface image data is larger than that of the pass separation data, it is possible to calculate the color material distribution difference with higher accuracy. In reverse, when the resolution of the outermost surface image data is smaller than that of the pass separation data, it is possible to calculate the color material distribution difference in higher speeds. In addition, it may be calculated considering variations in a landing-on position of a dot or in an area of a dot. For example, there is a method of providing variations by using random numbers.

In the present embodiment, the method of using the area ratio of the ink as the color material distribution is explained, but a method using the number of dots may be used. Specifically the modeling that a dot is a point is performed. When this method is used, it is possible to execute the processing in high speeds.

As explained above, according to the present embodiment, since the printing can be performed in the pass number by which the color material distribution difference can be sufficiently reduced corresponding to the input image, the band irregularities can be reduced.

(Second Embodiment)

In the first embodiment, the optimal pass number to the image data to be inputted is found by changing the pass number. In a second embodiment, an explanation will be made of a method of producing pass separation data such that a color material distribution difference can be reduced. It should be noted that mainly points different from the aforementioned embodiment will be briefly explained.

(Outline of Printing System)

A printing system in the second embodiment may be structured in the same way as that of the first embodiment.

(Pass Separation Processing Unit)

Next, an operation of the pass separation processing unit 310 according to the second embodiment will be in detail explained. The pass separation processing unit 310 outputs pass separation data to inputted ejection data such that band irregularities can be reduced corresponding to an input image. Specifically first, the pass separation data is produced by using a mask pattern. When a part of the pass separation data is changed and a color material distribution difference is reduced with this change, the change is adopted. When the color material distribution difference is not reduced with this change, the change is not adopted. The update of the pass separation data is thus repeated to produce pass separation data such that the color material distribution difference can be reduced.

Figure 9:
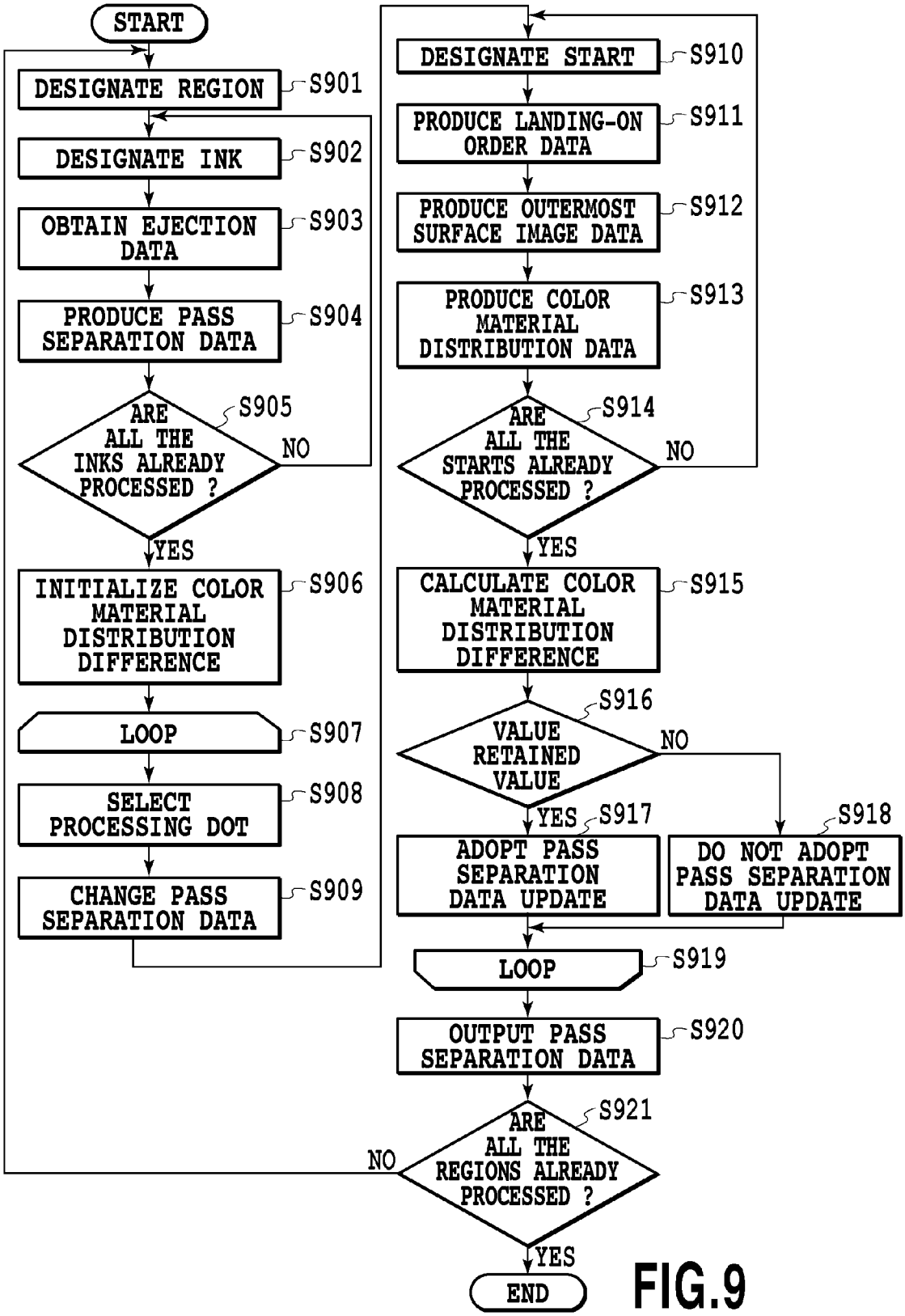
FIG. 9 is a flowchart illustrating the procedure of a pass separation processing unit according to a second embodiment.

FIG. 9 is a flow chart illustrating the procedure of the pass separation processing unit 310 according to the second embodiment.

When the process starts, the processing from S901 to S905 is carried out. The processing is similar to the processing from S402 to S406 according to the first embodiment.

Next, the color material distribution difference E is initialized (S906). The value to be initialized is in advance retained in the pass separation processing unit 310, and is a value as sufficiently large as to make a determination of NO at S916 to be described later without fail.

The processing is repeatedly carried out from S907 to S919 to produce pass separation data such that the color material distribution difference can be reduced. The repetition number is in advance retained in the pass separation processing unit 311, and for example, 1000 is retained. In the special processing a dot to be processed is selected, and the pass of the dot is changed. In addition, a color material distribution difference is calculated. If the calculated color material distribution difference is smaller than the color material distribution difference in advance retained, a change of the pass is adopted, and if it is larger, the change of the pass is not adopted.

Specifically by referring to the pass separation data first, a dot as a processing target is designated (S908). A way of designating the dot may be any method. For example, random numbers are generated, and it is possible to designate a dot to be processed based upon the random numbers at a random.

The pass of the designated dot is changed, and the pass separation data is changed (S909). The change of the pass separation data may be made by any method. For example, random numbers are generated, and it is possible to change the pass by the result. However, in a case of executing this processing at first, the pass does not change. At this time, the original pass separation data is retained.

Next, the processing from S910 to S914 is carried out. The processing can be carried out in the same way as the processing from S407 to S411 according to the first embodiment. Alternatively since an influence by changing the pass of the dot on the color material distribution lies only in the periphery of the dot, the processing only in the periphery of the designated dot may be used. In this case, high-speeding of the processing is possible.

In addition, the color material distribution difference is calculated (S915). The color material distribution data of the forward scan start is indicated at F1($k$), and the color material distribution data of the backward start is indicated at F2($k$). The color material distribution difference is calculated according to the following expression.

[Expression 3]

$$E=\Sigma_{k=0}^{4}(F1(k)-F2(k))^2 \quad \text{(Expression 3)}$$

Next, the color material distribution difference in advance retained and the updated color material distribution difference are compared. When it is determined that a value of the updated color material distribution difference is smaller, the process goes to S917 (S916). When it is determined that the value of the updated color material distribution difference is larger, the process goes to S918.

The pass separation data changed at S909 is adopted (S917).

The pass separation data changed at S909 is not adopted (the pass separation data before the change is adopted) (S918)

The loop ends after a predetermined repetition number of the processing is completed (S919).

A final pass separation data is outputted (S920).

Finally it is determined whether or not the processing is carried out in all the regions (S921). In a case where it is determined that the processing is carried out in all the regions, the process ends. In a case where it is determined that the processing is not carried out in all the regions, the process goes to S901, wherein the processing is carried out.

In the present embodiment, an explanation is made of the method of changing the pass separation data such that the color material distribution difference is reduced, but besides, there is considered a method of setting a target value of the color material distribution and updating the pass separation data in such a manner as to be closer to the target value. For example, there is a method in which an average value between the pass separation data of the forward scan start and the pass separation data of the backward scan start is set as a target value of the pass separation data. That is, when the target pass separation data is indicated at F3,

[Expression 4]

$$F3(k) = \frac{F1(k) + F2(k)}{2} \quad \text{(Expression 4)}$$

This target value is required to be additionally calculated at the processing at S915. When the processing at S909 is carried out based upon the target value, it is possible to more efficiently reduce the color material distribution difference. For example, there is a method of executing the processing from ink in which the color material distribution difference is made larger. In a case of increasing the distribution of cyan ink, the pass separation data may be changed such that a cyan dot is printed in a later pass.

Further, in the present embodiment, the pass separation data in common between the region of the forward scan start and the region of the backward scan start is used, but the pass separation data may differ for each region. When this method is used, since it is possible to independently process F1 and F2, it is possible to more efficiently reduce the color material distribution difference.

In any method, it is possible to reduce the color material distribution difference by the processing from S916 to S918 without fail.

As described above, according to the present invention, since the area ratio for each print material is kept to be substantially constant in the reciprocal scans to produce the pass separation data such that the color material distribution difference is reduced without fail, it is possible to reduce band irregularities.

(Third Embodiment)

In the second embodiment, the pass separation data is produced such that the color material distribution difference is reduced by modifying the pass separation data once produced. In the third embodiment, an explanation will be made of a method of producing a plurality of pass separation data and determining pass separation data in which the color material distribution difference is the smallest out of the plurality of pass separation data. Mainly points different from those in the aforementioned embodiment will be briefly explained.

(Outline of Printing System)

A printing system in the third embodiment may be structured in the same way as that of the first embodiment.

(Pass Separation Processing Unit)

Processing of the pass separation processing unit 310 according to the third embodiment will be in detail explained. The pass separation processing unit 310 outputs pass separation data to inputted ejection data such that band irregularities can be reduced corresponding to an input image.

Subsequently, the pass separation processing unit 310 according to the third embodiment will be in detail explained. The pass separation processing unit 310 produces pass separation data of the pass number in such a manner that band irregularities are reduced corresponding to an input image. Specifically a plurality of pass separation data is produced by using a plurality of mask patterns, a color material distribution difference on the outermost surface is calculated from each pass separation data, and the pass separation data in which the color material distribution difference on the outermost surface is the smallest is selected, which is outputted to the head drive circuit.

Figure 10:
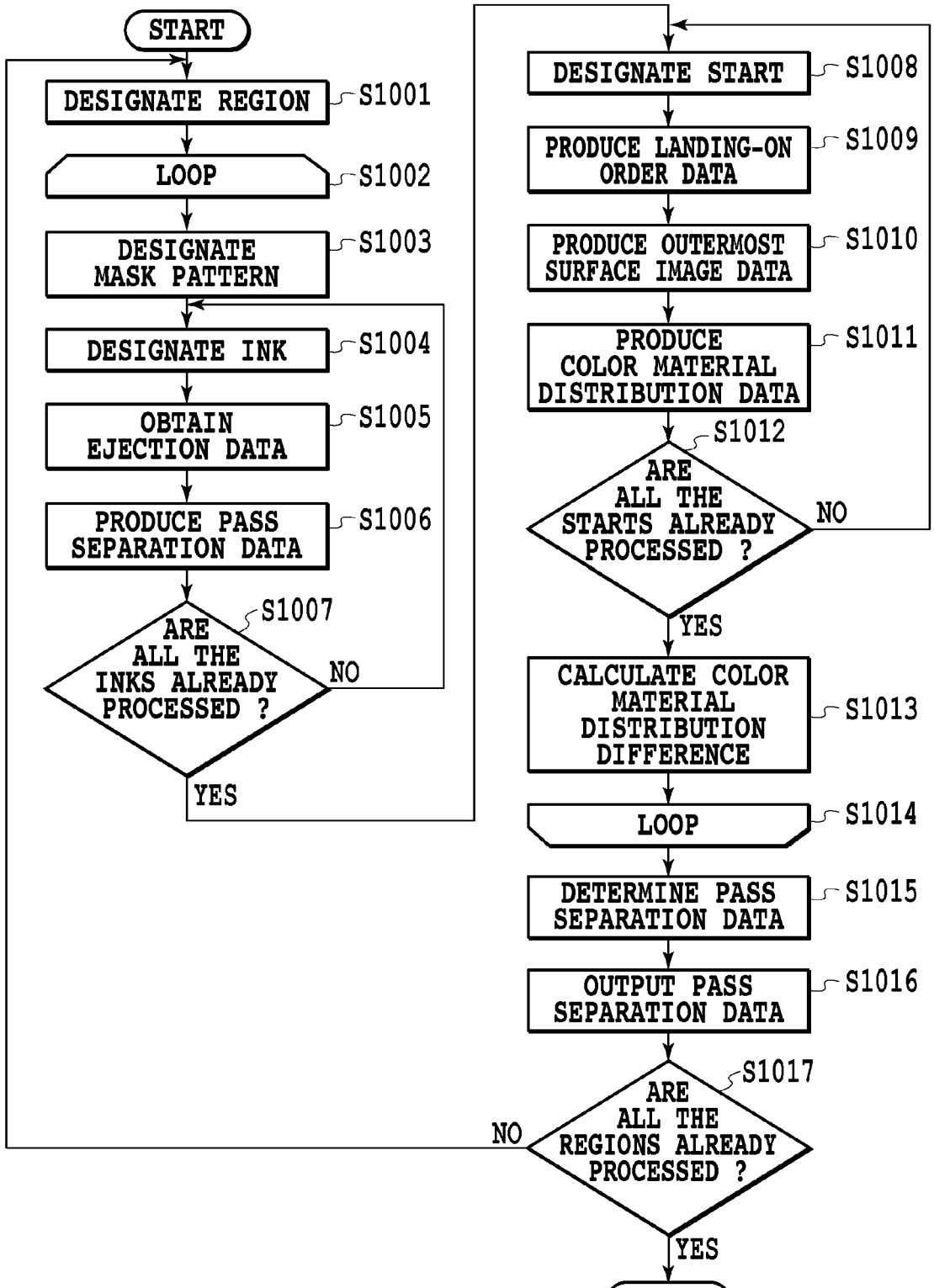
FIG. 10 is a flowchart illustrating the procedure of a pass separation processing unit according to a third embodiment.

FIG. 10 is a flow chart illustrating the procedure of the pass separation processing unit 310 according to the third embodiment.

When the process starts, the processing at S1001 is carried out. The processing is similar to the processing from S402 to S406 in the first embodiment.

Next, the repetition processing is carried out from S1002 to S1013 to select pass separation data such that the color material distribution difference can be reduced. The repetition number is in advance retained in the pass separation processing unit 310. In a case of many repetition numbers, the processing requires a long time, and in a case of small repetition numbers, the reduction effect becomes small. For example, number 10 is retained as the repetition number.

The loop starts (S1002). First, the mask pattern is designated (S1003). A plurality of mask patterns are in advance retained in the pass separation processing unit 310. Each time this processing is carried out, a different mask pattern is designated.

Next, the processing from S1004 to S1013 is carried out. The processing is the same as the processing from S403 to S412 according to the first embodiment.

A predetermined number of processing is carried out and the loop ends (S1014).

Subsequently the pass separation data is determined (S1015). The pass separation data is selected such that the color material distribution difference is reduced to be the smallest. In the present embodiment, one pass separation data is selected from 10 kinds of pass separation data.

Next, the pass separation data is outputted (S1016).

Finally it is determined whether or not the processing is carried out in all the regions (S1017). In a case where it is determined that the processing is carried out in all the regions, the process ends. In a case where it is determined that the processing is not carried out in all the regions, the process goes to S1001, wherein the processing is carried out.

In the third embodiment, an explanation is made of the method in which the pass separation data in common between the region of the forward scan start and the region of the backward scan start is used, but the pass separation data may differ for each region. When this method is used, since it is possible to select a combination of data from 10 kinds of the color material distribution data in the forward scan start and 10 kinds of the color material distribution data in the backward scan start such that the color material distribution difference is the smallest, it is possible to select the pass separation data in which the color material distribution difference is the smallest.

In addition, the present invention can be also realized by supplying a storage medium storing program codes of software realizing the functions of the aforementioned embodiments (for example, the process indicated by the above flow chart) to a system or device. In this case, a computer (or CPU or MPU) in the system or device reads out and executes the program code stored in the storage medium to be computer-readable to realize the functions of the aforementioned embodiments.

As described above, according to the present embodiment, the band irregularities can be reduced.

(Other Embodiment)

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment (s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-143425, filed Jun. 28, 2011, which is hereby incorporated by reference herein in its entirety.

What is claimed is:

1. An image forming apparatus in which an operation of reciprocal scans of a print head including a plurality of ejection ports for ejecting dots corresponding to at least two kinds of inks onto a print medium and an operation of conveying the print medium are repeatedly performed and in the meanwhile ink is ejected from the print head to the print medium for printing, where the dots ejected adjacently overlap each other in part, comprising:

an input unit configured to input ejection data for ejecting the ink onto the print medium to form an image;

a calculating unit configured to calculate an area ratio of each ink on the surface of the print medium based upon the ejection data; and a setting unit configured to set the ejection data based upon the calculated area ratio in such a manner that the area ratio is generally constant in the reciprocal scans.

2. The image forming apparatus according to claim 1, wherein the setting unit is further configured to set the scan number of times of the reciprocal scans such that the area ratio is substantially constant in the reciprocal scans.

3. The image forming apparatus according to claim 1, wherein the setting unit is further configured to update ejection data in each of the reciprocal scans such that the area ratio is substantially constant in the reciprocal scans.

4. The image forming apparatus according to claim 1, wherein the setting unit is further configured to produce a plurality of the ejection data by using different mask patterns and calculate the area ratio for each ejection data produced by the producing means.

5. The image forming apparatus according to claim 1, wherein the calculating unit is configured to calculate the area ratio based upon the ejection data by modeling a size of a dot ejected to the print medium.

6. The image forming apparatus according to claim 5, wherein the ejection data includes landing-on order data which show an order by which the dots land on the print medium.

7. An image forming method in which an operation of reciprocal scans of a print head including a plurality of ejection ports for ejecting dots corresponding to at least two kinds of inks onto a print medium and an operation of conveying the print medium are repeatedly performed, and in the meanwhile ink is ejected from the print head to the print medium for printing, where the dots ejected adjacently overlap each other in part, comprising:

an input step of inputting ejection data for ejecting the ink onto the print medium to form an image;

a calculating step of calculating an area ratio of each ink on the surface of the print medium based upon the ejection data; and a setting step of setting the ejection data based upon the calculated area in such a manner that the area ratio is generally constant in the reciprocal scans.

8. A non-transitory recording medium storing a program that causes an image forming apparatus to execute an image forming method according to claim 7.

* * * * *